US006820742B1

(12) United States Patent
Chen

(10) Patent No.: US 6,820,742 B1
(45) Date of Patent: Nov. 23, 2004

(54) DISPLAY PACK HAVING TOOL TRY-ON STRUCTURE

(76) Inventor: Chia Yu Chen, P.O. Box 63-99, Taichung (TW), 406

( * ) Notice: Subject to any disclaimer, the term of this patent is extended or adjusted under 35 U.S.C. 154(b) by 12 days.

(21) Appl. No.: 10/461,619

(22) Filed: Jun. 12, 2003

(51) Int. Cl.[7] ..... B65D 85/28

(52) U.S. Cl. ..... 206/378; 206/1.5; 206/375; 211/70.6

(58) Field of Search ..... 206/349, 378, 206/372, 373, 1.5, 471, 461, 807, 375; 211/69, 70.6

(56) References Cited

U.S. PATENT DOCUMENTS 5,335,772 A * 8/1994 Chervenak et al. ..... 206/349
5,785,174 A 7/1998 Chow ..... 206/349
6,082,539 A * 7/2000 Lee ..... 206/373
6,105,767 A * 8/2000 Vasudeva ..... 206/372
6,375,005 B1 * 4/2002 McCann ..... 206/349
6,409,015 B1 * 6/2002 Hu ..... 206/378
6,719,154 B2 * 4/2004 Kao ..... 211/70.6
2002/0027092 A1 * 3/2002 Hu ..... 206/378

* cited by examiner

*Primary Examiner*—Jacob K. Ackun
*Assistant Examiner*—Bena B. Miller
(74) *Attorney, Agent, or Firm*—Charles E. Baxley

(57) ABSTRACT

A display pack includes a housing and a cover pivotally secured together to receive tool members. A seat is extended from the housing and includes an opening to rotatably receive a rotary member, and includes a toothed portion. The rotary member also includes a toothed portion to engage with the toothed portion of the seat, and to generate click when the rotary member is rotated relative to the seat. A driving tool includes a driving shank extended from a head to engage into the rotary member, and to rotate the rotary member relative to the seat and the housing. The cover includes a casing to rotatably retain the head of the driving tool between the seat and the casing.

8 Claims, 5 Drawing Sheets

DISPLAY PACK HAVING TOOL TRY-ON STRUCTURE

BACKGROUND OF THE INVENTION

1. Field of the Invention

The present invention relates to a display pack, and more particularly to a display pack having a structure for allowing packed tools to be tried by the customers or users.

2. Description of the Prior Art

Various kinds of typical display packs have been developed for packaging and displaying tool members, and comprise a retaining structure or device to retain or hold the tool members in place, and to partially expose the tool members, for allowing the tool members to be tried or tested by the customers or users.

For example, U.S. Pat. No. 5,785,174 to Chow, and U.S. Pat. No. 6,409,015 to Hu disclose two of the typical display packs that also comprise a retaining structure or device to retain or hold the tool members in place. The tool members include a partially exposed handle portion to be rotated or tried or tested by the customers or users.

However, the tool members have the middle portion retained in the pack device, such that the handle of the tool members may not be easily rotated by the customers or users.

In addition, a tiny space will be formed or defined by a locking frame to receive the handle of the tool members. However, it will be difficult to engage the handle of the tool members into the tiny space formed or defined by the locking frame.

Furthermore, the locking frame should be distorted or cut after the customers or users purchase the display packs, and thus may not be used to lock the tool member in the display pack after the locking frame has been cut or damaged.

In addition, the tool packs normally include the tiny space to receive the handle of the tool members only, and may not be used to receive the other tool members.

The present invention has arisen to mitigate and/or obviate the afore-described disadvantages of the conventional display packs for tool members.

SUMMARY OF THE INVENTION

The primary objective of the present invention is to provide a display pack including a structure for allowing packed tools to be easily tried by the customers or users.

The other objective of the present invention is to provide a display pack including a structure for allowing tool members to be easily packed in the display pack.

The further objective of the present invention is to provide a display pack including a structure for allowing the other tool members to be received or packed within the display pack.

The still further objective of the present invention is to provide a display pack including a structure for allowing the tool members to be received or packed within the display pack even after the locking members have been damaged.

In accordance with one aspect of the invention, there is provided a display pack comprising a housing including a chamber formed therein, and including a first side and a second side, a seat extended from the second side of the housing, and including an opening formed therein, and including a toothed portion provided therein, at least one tool member received in the chamber of the housing, a rotary member rotatably received in the opening of the seat, and including a toothed portion provided thereon, and facing toward the toothed portion of the seat, to engage with the toothed portion of the seat, and to generate click when the rotary member is rotated relative to the seat, and the rotary member including an engaging hole formed therein, a driving tool including a head having a driving shank extended therefrom, and engageable into the engaging hole of the rotary member, the driving tool including a handle extended out of the seat and the housing, a cover including a first side pivotally secured to the first side of the housing, and including a second side, latching means for openably latching the second sides of the housing and the cover together, and a casing extended from the second side of the cover, and including a chamber formed therein to partially receive the head of the driving tool, and to rotatably retain the head of the driving tool between the seat and the casing, and to allow the handle of the driving tool to be operated by users.

The seat includes a peripheral flange extended into the opening thereof, to form an orifice therein, the rotary member includes at least one leg extended therefrom and engaged through the orifice of the seat, and engaged with the seat to rotatably secure the rotary member to the seat. The toothed portion of the seat is formed in the peripheral flange of the seat, and arranged around the orifice of the seat.

The latching means includes at least one first latch member provided on the second side of the housing, and at least one second latch member provided on the second side of the cover and engageable with the first latch member of the housing, to openably latch the second sides of the housing and the cover together.

The casing includes a wall member to define the chamber thereof, and includes a hub provided on the wall member thereof, the driving tool includes a driving stem extended from the head and rotatably received in the hub of the casing.

The driving tool includes a knob extended out of the casing, to be actuated by users. The housing includes a pad received in the chamber thereof, the pad includes at least one depression formed therein to receive the tool member.

A locking device may further be provided for locking the seat and the casing together, to prevent the driving tool from being removed from the seat and the casing.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
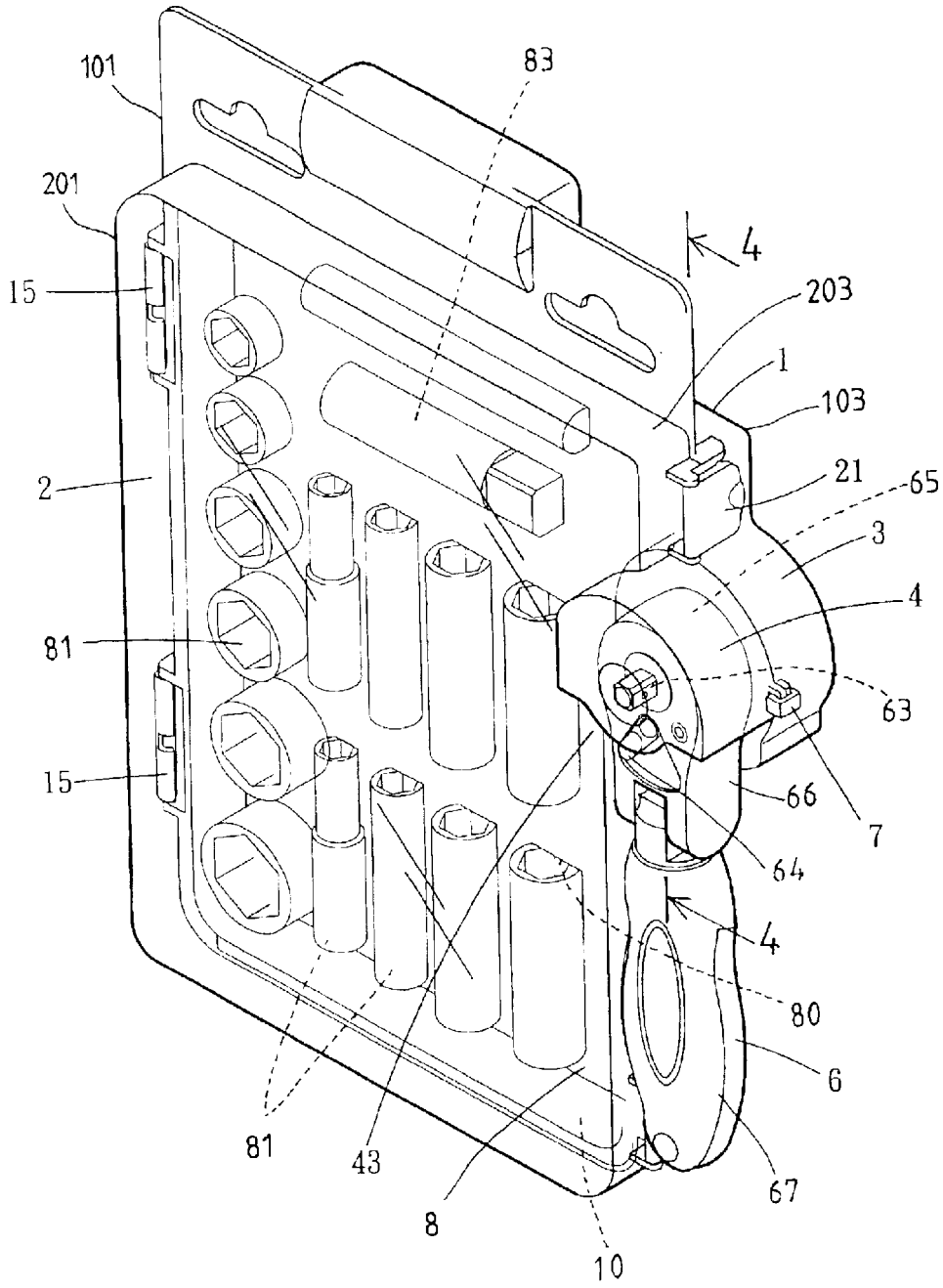
FIG. 1 is a perspective view of a display pack in accordance with the present invention.
Figure 3:
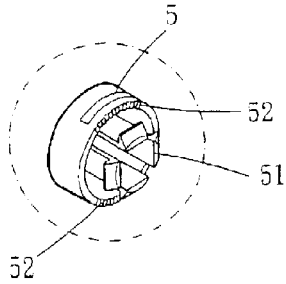
FIG. 3 is a perspective view of a rotary member for the display pack.

Referring to the drawings, and initially to FIGS. 1-5, a display pack in accordance with the present invention comprises a housing 1 including a chamber 10 formed therein to receive a pad 8 therein. The pad 8 includes a number of depressions 80 formed therein to receive various kinds of tool members 81, 83 therein, such as sockets 81, tool shanks 83, or the like.

A cover 2 may further be provided and also includes a chamber 20 formed therein to partially receive the tool members 81, 83 therein, and includes one side 201 pivotally or rotatably secured to one side 101 of the housing 1 with hinges 15 or the like, for allowing the cover 2 to be opened or closed relative to the housing 1, in order to stably retain the tool members 81, 83 within the chamber 10 of the housing 1.

The housing 1 includes one or more, such as two latch members 11 formed or provided on the other side 103 thereof, and the cover 2 also includes one or more, such as two latch members 21 formed or provided on the other side 203 thereof, to engage with the latch members 11 of the housing 1, and to latch the housing 1 and the cover 2 together (FIGS. 1, 5), and thus to further solidly retain the tool members 81, 83 within the chamber 10 of the housing 1.

Figure 2:
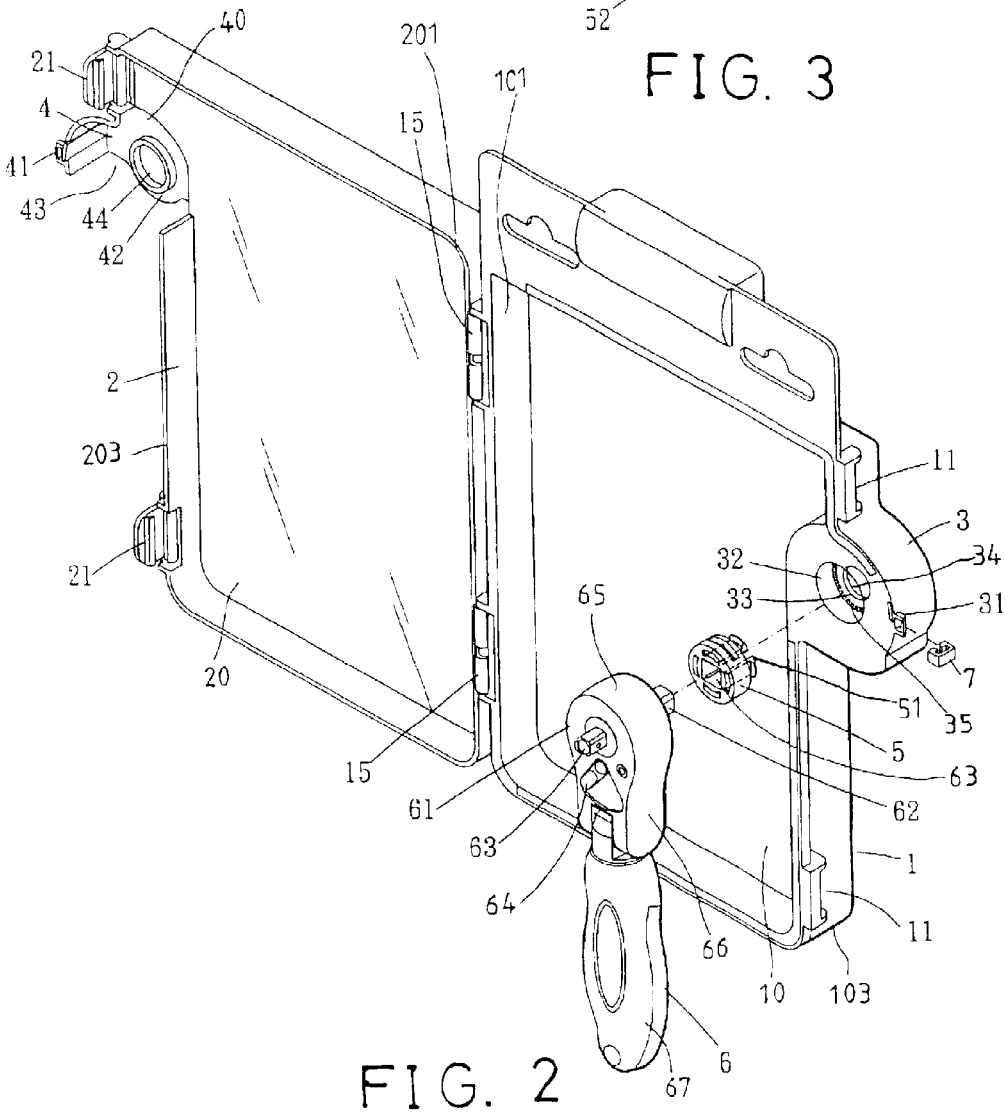
FIG. 2 is a partial exploded view of the display pack.
Figure 4:
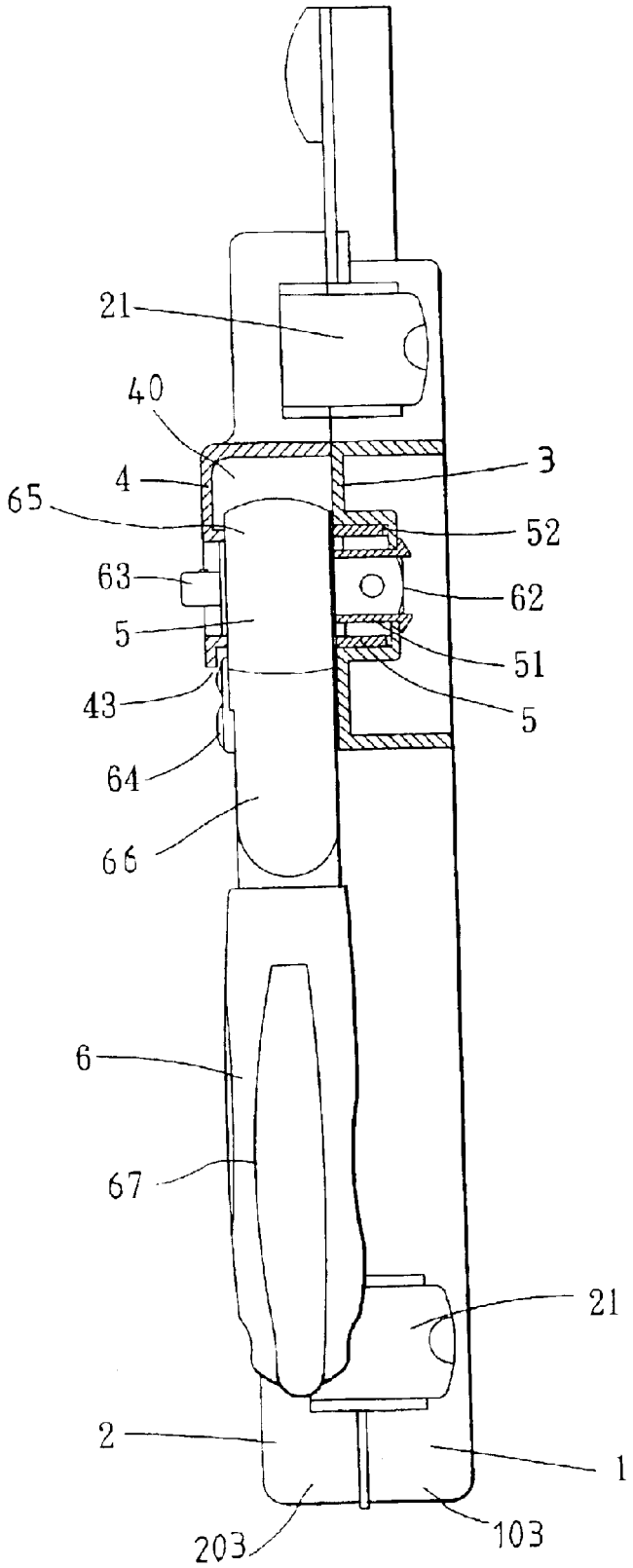
FIG. 4 is a partial cross sectional view of the display pack, taken along lines 4—4 of FIG. 1.

The housing 1 includes a seat 3 provided on the other side 103 thereof, and extended laterally and outwardly from the housing 1, and having an opening 32 formed therein (FIG. 2). The seat 3 includes a peripheral flange 33 extended into the opening 32 thereof, to form or define an orifice 34 therein which includes an inner diameter smaller than that of the opening 32 thereof, and the seat 3 includes a toothed portion 35 formed in the peripheral flange 33 and arranged around the orifice 34 thereof.

A rotary member 5 is rotatably received in the opening 32 of the seat 3, and includes one or more spring-biased catches or hooks or legs 51 extended therefrom (FIGS. 3, 4), and engaged through the orifice 34 of the seat 3, and engaged with the seat 3 (FIG. 4), to rotatably secure or attach the rotary member 5 to the seat 3. The rotary member 5 includes an engaging hole 53 formed therein (FIG. 2), to receive a driving shank 62 of a driving tool 6 that is formed or provided on a head 61 of the driving tool 6.

The rotary member 5 includes one or more toothed portions 52 formed thereon, and facing toward the toothed portion 35 of the seat 3, for engaging with the toothed portion 35 of the seat 3, and to generate click when the rotary member 5 is rotated relative to the seat 3, by the driving tool 6, for example. The driving tool 6 may include a driving stem 63 extended from the other side, opposite to the driving shank 62, and a typical rotatable or switchable knob 64 provided on the other side thereof.

The cover 2 includes a casing 4 provided on the other side 203 thereof, and extended laterally and outwardly from the housing 1, and having a chamber 40 formed therein (FIGS. 2, 4) and defined by a wall member 42 to partially receive the upper portion or free end portion 65 of the head 61 of the driving tool 6. The wall member 42 includes a hub 44 provided or extended from the wall member 42 and extended into the chamber 40 thereof, to rotatably receive the driving stem 63 of the driving tool 6.

Figure 5:
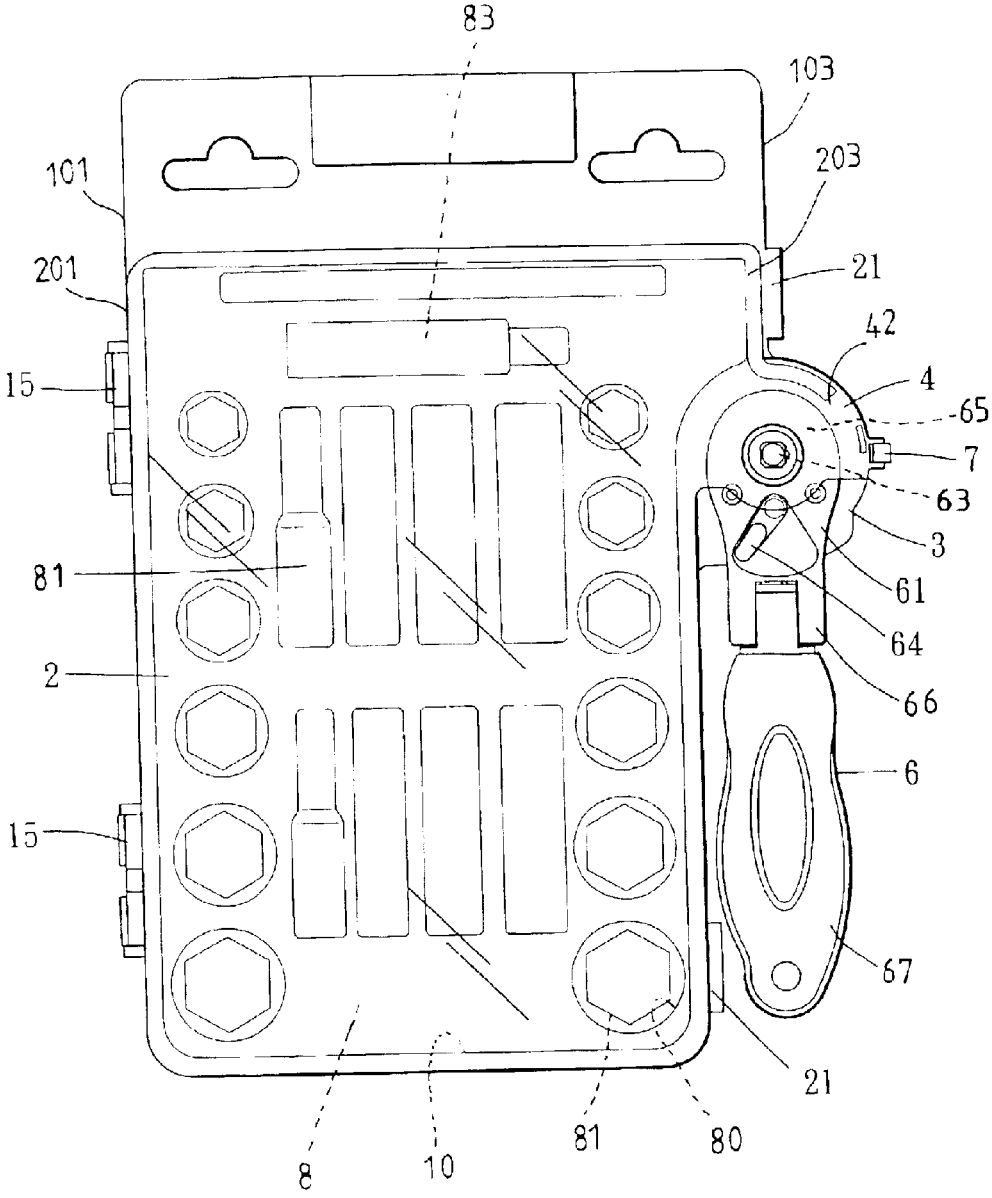
FIG. 5 is a front plan view of the display pack.
Figure 7:
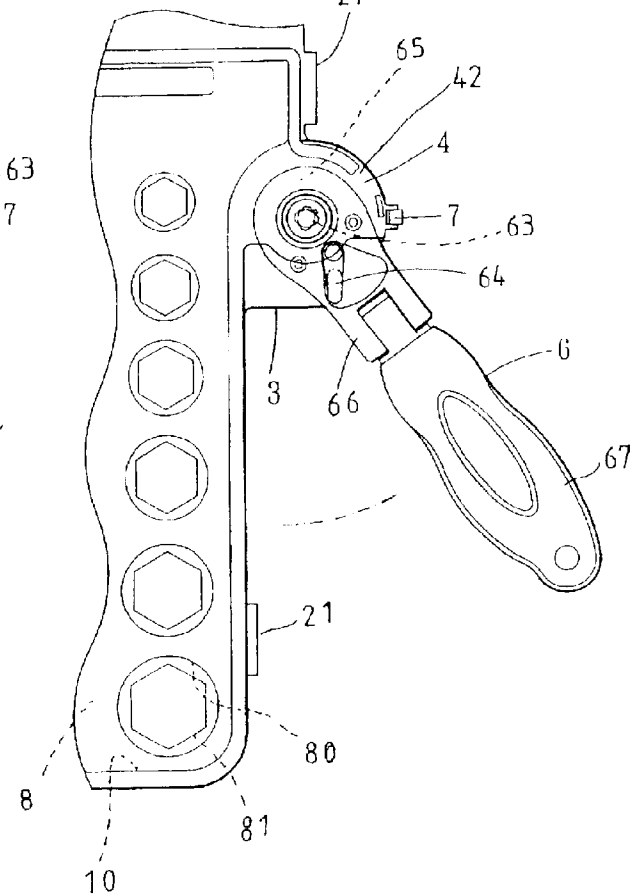
FIGS. 6, 7 are partial front plan views of the display pack, illustrating the operation of the display pack.
Figure 6:
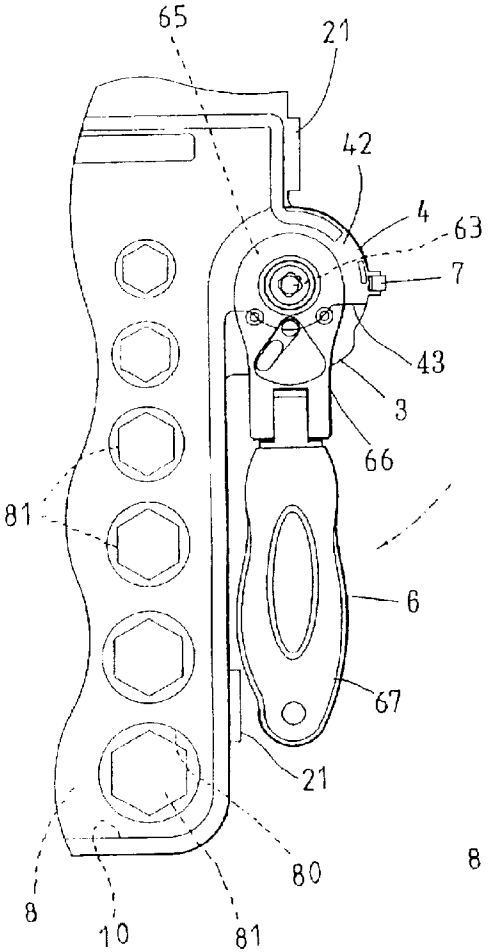

The casing 4 of the cover 2 includes an open bottom 43 for exposing the lower portion 66 of the head 61 of the driving tool 6, and for allowing the knob 64 of the driving tool 6 to be exposed or extended out of the casing 4, and to be switched or rotated or actuated by the customers or users (FIGS. 5-7). The driving tool 6 thus has only the upper portion or free end portion 65 thereof received in the casing 4, and has the other or lower portion 66 of the head 61 and the handle 67 exposed or extended out of the casing 4, such that the driving tool 6 may be easily tried or tested by the customers or users.

The seat 3 of the housing 1 further includes a lock ear 31 extended therefrom, and the casing 4 of the cover 2 also includes a lock ear 41 extended therefrom, and a lock member 7 may be engaged with the lock ears 31, 41 to lock the seat 3 and the casing 4 together, and to prevent the driving tool 6 from being removed from the housing 1 by the customers or users.

In operation, the rotary member 5 may be rotatably engaged or received in the opening 32 of the seat 3 by the engagement of the spring-biased legs 51 with the seat 3. The driving shank 62 of the driving tool 6 may then be easily engaged into the engaging hole 53 of the rotary member 5. The casing 4 of the cover 2 may then be engaged onto the upper portion or free end portion 65 of the head 61 of the driving tool 6, and to expose lower portion 66 of the head 61 and the handle 67, and thus to allow the driving tool 6 to be easily tried or tested by the customers or users.

The housing 1 and the cover 2 may be openably secured together with the latch members 11, 21. The seat 3 and the casing 4 may be locked together by the lock member 7, to prevent the driving tool 6 from being removed from the housing 1 by the customers or users. When the lock member 7 is cut and disengaged from the seat 3 and the casing 4 after the customer has purchased the display pack, the driving tool 6 may still be retained between the seat 3 and the casing 4 by the latch members 11, 21 of the housing 1 and the cover 2.

Accordingly, the display pack in accordance with the present invention includes a structure for allowing packed tools to be easily tried by the customers or users, and for allowing tool members to be easily packed in the display pack, and for allowing the other tool members to be received or packed within the display pack, and for allowing the tool members to be received or packed within the display pack even after the locking members have been damaged.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A display pack comprising:

a housing including a chamber formed therein, and including a first side and a second side, a seat extended from said second side of said housing, and including an opening formed therein, and including a toothed portion provided therein, at least one tool member received in said chamber of said housing, a rotary member rotatably received in said opening of said seat, and including a toothed portion provided thereon, and facing toward said toothed portion of said seat, to engage with said toothed portion of said seat, and to generate click when said rotary member is rotated relative to said seat, and said rotary member including an engaging hole formed therein, a driving tool including a head having a driving shank extended therefrom, and engageable into said engaging hole of said rotary member, said driving tool including a handle extended out of said seat and said housing, a cover including a first side pivotally secured to said first side of said housing, and including a second side, latching means for openably latching said second sides of said housing and said cover together, and a casing extended from said second side of said cover, and including a chamber formed therein to partially receive said head of said driving tool, and to rotatably retain said head of said driving tool between said seat and said casing, and to allow said handle of said driving tool to be operated by users.

2. The display pack as claimed in claim 1, wherein said seat includes a peripheral flange extended into said opening thereof, to form an orifice therein, said rotary member includes at least one leg extended therefrom and engaged through said orifice of said seat, and engaged with said seat to rotatably secure said rotary member to said seat.

3. The display pack as claimed in claim 2, wherein said toothed portion of said seat is formed in said peripheral flange of said seat, and arranged around said orifice of said seat.

4. The display pack as claimed in claim 1, wherein said latching means includes at least one first latch member provided on said second side of said housing, and at least one second latch member provided on said second side of said cover and engageable with said at least one first latch member of said housing, to openably latch said second sides of said housing and said cover together.

5. The display pack as claimed in claim 1, wherein said casing includes a wall member to define said chamber thereof, and includes a hub provided on said wall member thereof, said driving tool includes a driving stem extended from said head and rotatably received in said hub of said casing.

6. The display pack as claimed in claim 1, wherein said driving tool includes a knob extended out of said casing, to be actuated by users.

7. The display pack as claimed in claim 1, wherein said housing includes a pad received in said chamber thereof, said pad includes at least one depression formed therein to receive said at least one tool member.

8. The display pack as claimed in claim 1 further comprising locking means for locking said seat and said casing together, to prevent said driving tool from being removed from said seat and said casing.

* * * * *